US007281507B2

(12) United States Patent
Uehama et al.

(10) Patent No.: US 7,281,507 B2
(45) Date of Patent: Oct. 16, 2007

(54) VALVE TIMING ADJUSTING APPARATUS

(75) Inventors: Motoki Uehama, Kariya (JP); Yasushi Morii, Nagoya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/514,943

(22) Filed: Sep. 5, 2006

(65) Prior Publication Data

US 2007/0051330 A1 Mar. 8, 2007

(30) Foreign Application Priority Data

Sep. 5, 2005 (JP) ..... 2005-256778

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,637,389 B2 10/2003 Schafer et al.
6,883,482 B2 * 4/2005 Takenaka et al. ..... 123/90.17

FOREIGN PATENT DOCUMENTS

DE 41 10 195 C2 2/2000
JP 9-60509 3/1997

OTHER PUBLICATIONS

US Serial No. Not yet assigned; Filed Sep. 5, 2006; Inv.: Uehama et al; JP counterpart JP 2005-256779.
US Serial No. Not yet assigned; Filed Sep. 5, 2006; Inv.: Uehama et al; JP counterpart JP 2005-256779.

* cited by examiner

*Primary Examiner*—Zelalem Eshete
(74) *Attorney, Agent, or Firm*—Nixon & Vanderhye P.C.

(57) ABSTRACT

A driving-side rotatable body includes a driving-side inner gear, which has an axial extent that does not overlap with an axial extent of a driven-side inner gear of a driven-side rotatable body. A driven-side outer gear and a driving-side outer gear of a planet gear are meshed with and are driven together with the driven-side inner gear and the driving-side inner gear, so that the planet gear changes a relative rotational phase between the driven-side rotatable body and the driving-side rotatable body. A length of a tooth contact between the driven-side inner gear and the driven-side outer gear measured in a direction of a tooth trace thereof is set to be longer than a length of a tooth contact between the driving-side inner gear and the driving-side outer gear measured in a direction of a tooth trace thereof.

6 Claims, 4 Drawing Sheets

VALVE TIMING ADJUSTING APPARATUS

CROSS REFERENCE TO RELATED APPLICATION

This application is based on and incorporates herein by reference Japanese Patent Application No. 2005-256778 filed on Sep. 5, 2005. This application is also related to U.S. application Serial No. 11/515,200, entitled "VALVE TIMING ADJUSTING APPARATUS," filed on Sep. 5, 2006 and U.S. application Serial No. 11/515,247, entitled "VALVE TIMING ADJUSTING APPARATUS," filed on Sep. 5, 2006.

BACKGROUND OF THE INVENTION

1. Field of the Invention

The present invention relates to a valve timing adjusting apparatus that adjusts valve timing of at least one of an intake valve and an exhaust valve of an internal combustion engine that are opened and closed by a camshaft upon transmission of a torque from a crankshaft.

2. Description of Related Art

In one known valve timing adjusting apparatus, the valve timing is adjusted by changing a relative rotational phase between two rotatable bodies, which are rotated synchronously with the crankshaft and the camshaft, respectively. For example, DE4110195C2 discloses a valve timing adjusting apparatus, which changes a relative rotational phase between two rotatable bodies through use of a differential gear mechanism, which includes a planet gear as its main component. Specifically, in the apparatus of DE4110195C2, two inner gears are provided to the rotatable body synchronized with the crankshaft and the rotatable body synchronized with the camshaft, respectively, and axial extents of these two inner gears do not overlap with each other. These inner gears are meshed with two outer gears, respectively, of the planet gear. In this way, a large speed reducing ratio can be obtained with the compact design.

In the apparatus disclosed in DE4110195C2, the inner gear (hereinafter, referred to as a camshaft-side inner gear), which is provided to the rotatable body synchronized with the camshaft, directly receives the oscillating torque of the camshaft. Thus, a relatively large surface pressure is generated in a tooth contact part between the camshaft-side inner gear and the corresponding outer gear. In contrast, the inner gear (hereinafter, referred to as a crankshaft-side inner gear), which is provided to the rotatable body synchronized with the crankshaft, receives a reduced oscillating torque due to the action of the differential gear mechanism, which is formed by the crankshaft-side inner gear in cooperation with the camshaft-side inner gear and the planet gear, so that a relatively small surface pressure is generated in a tooth contact part between the crankshaft-side inner gear and the corresponding outer gear. Furthermore, the torque of the crankshaft, which uniformly rotates the camshaft, is normally smaller than the oscillating torque of the camshaft, so that the surface pressure generated in the contact part between the crankshaft-side inner gear and the corresponding outer gear should be reduced.

However, in the apparatus disclosed in DE4110195C2, the length of the tooth contact between the camshaft-side inner gear and the corresponding outer gear measured in the direction of the tooth trace thereof is smaller than the length of the tooth contact between the crankshaft-side inner gear and the corresponding outer gear measured in the direction of the tooth trace thereof. In this way, the tooth contact surface area between the camshaft-side inner gear and the corresponding outer gear is made smaller than the contact surface area between the crankshaft-side inner gear and the corresponding outer gear. Therefore, the camshaft-side inner gear and the corresponding outer gear need to withstand the relatively large surface pressure generated in the tooth contact part between the camshaft-side inner gear and the corresponding outer gear. This can be accomplished by increasing the rigidity of the camshaft-side inner gear and of the corresponding outer gear by, for example, use of a highly rigid material or a hardening treatment. However, this will result in an increase in the manufacturing cost.

SUMMARY OF THE INVENTION

The present invention addresses the above disadvantage, and it is an objective of the present invention to provide a valve timing adjusting apparatus, which can achieve a sufficient durability thereof and can minimize a manufacturing cost thereof.

To achieve the objective of the present invention, there is provided a valve timing adjusting apparatus that adjusts valve timing of at least one of an intake valve and an exhaust valve of an internal combustion engine, which are opened and closed by a camshaft upon transmission of a torque from a crankshaft to the camshaft. The valve timing adjusting apparatus includes a first rotatable body, a second rotatable body and a planet gear. The first rotatable body includes a first inner gear and is rotated synchronously with the camshaft. The second rotatable body includes a second inner gear, which has an axial extent that does not overlap with an axial extent of the first inner gear. The second rotatable body is rotated synchronously with the crankshaft. The planet gear includes a first outer gear and a second outer gear. The first outer gear and the second outer gear are meshed with and are driven together with the first inner gear and the second inner gear, respectively, to have a sun-and-planet motion, so that the planet gear changes a relative rotational phase between the first rotatable body and the second rotatable body. A length of a tooth contact between the first inner gear and the first outer gear measured in a direction of a tooth trace thereof is set to be longer than a length of a tooth contact between the second inner gear and the second outer gear measured in a direction of a tooth trace thereof.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings.

Figure 2:
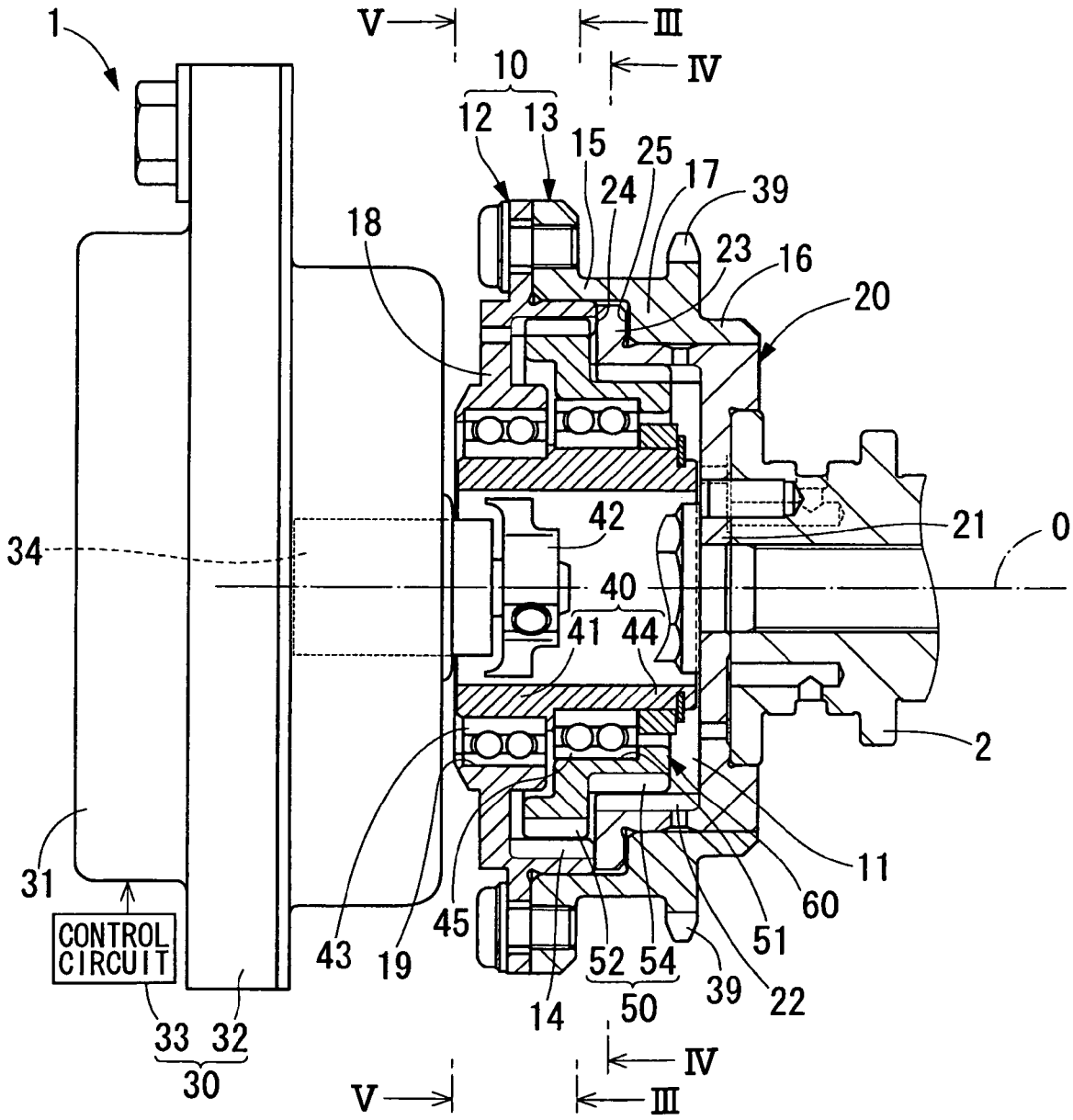
FIG. 2 is a cross sectional view taken along line II-II in FIG. 3, showing the valve timing adjusting apparatus according to the embodiment.

FIG. 2 shows a valve timing adjusting apparatus 1 according to an embodiment of the present invention. The valve timing adjusting apparatus 1 is provided in a transmission system, which transmits an engine torque from a crankshaft of an internal combustion engine to a camshaft 2. The valve timing adjusting apparatus 1 changes a relative rotational phase between the crankshaft and the camshaft 2 to adjust valve timing of an intake valve of the internal combustion engine.

The valve timing adjusting apparatus 1 includes a driving-side rotatable body 10, a driven-side rotatable body 20, a control unit 30, a planet carrier 40 and a planet gear 50.

The driving-side rotatable body 10 and the driven-side rotatable body 20 cooperate together to form a receiving space 11, which receives the planet carrier 40 and the planet gear 50.

Figure 3:
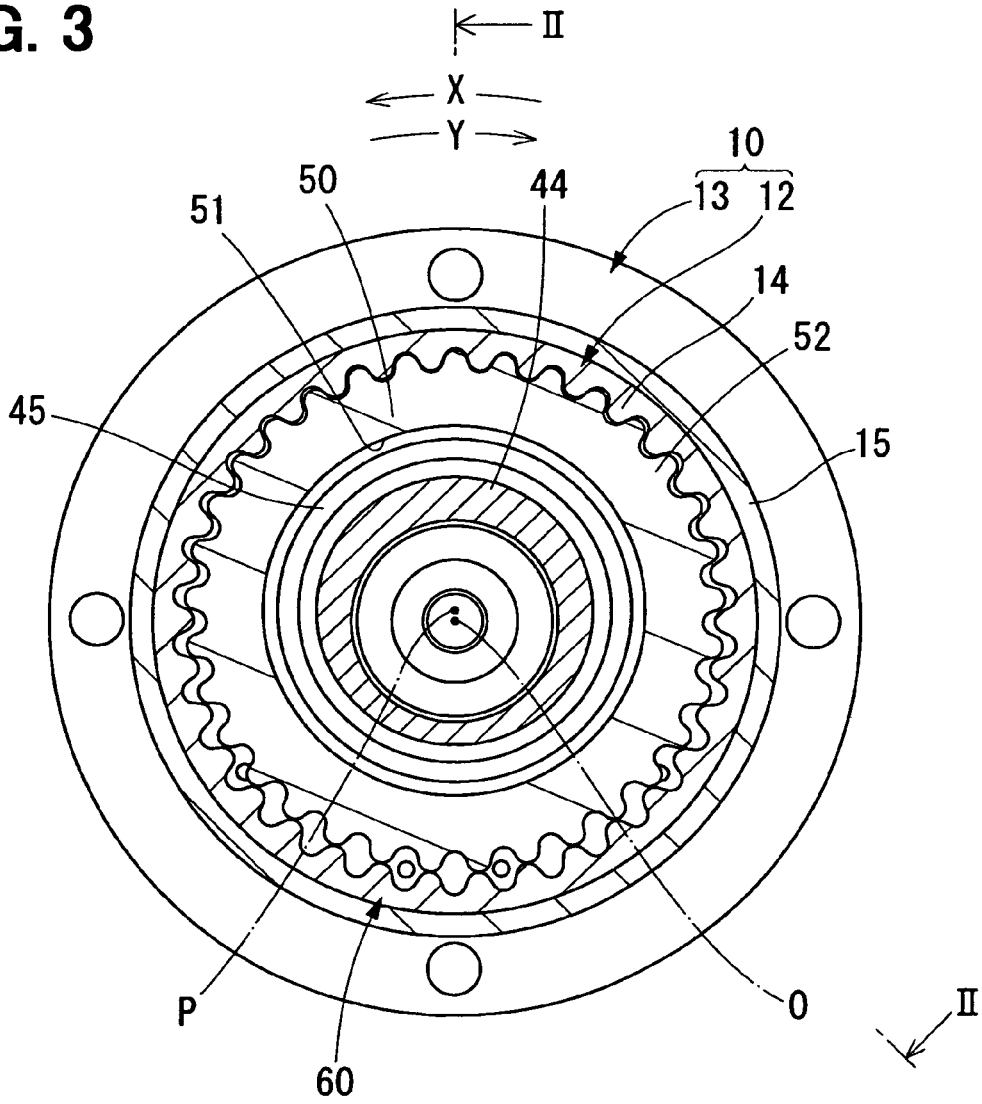
FIG. 3 is a cross sectional view taken along line III-III in FIG. 2.

As shown in FIGS. 2 and 3, the driving-side rotatable body 10 includes a cup shaped gear member 12 and a double-stepped cylindrical sprocket 13, which are coaxially arranged relative to each other. A peripheral wall of the gear member 12 forms a driving-side inner gear 14, which has an addendum circle positioned radially inward of its dedendum circle and also has a tooth trace that extends in the axial direction. The gear member 12 is fixed to the sprocket 13 by screws in a state where an outer peripheral wall of the driving-side inner gear 14 is engaged with an inner peripheral wall of a large diameter portion 15 of the sprocket 13. In the sprocket 13, a stepped portion 17, which connects between the large diameter portion 15 and a small diameter portion 16, includes a plurality of teeth 39, which project radially outward. An annular timing chain is wound around the teeth 39 and teeth of the crankshaft. Therefore, when the engine torque, which is outputted from the crankshaft, is supplied to the sprocket 13 through the timing chain, the driving-side rotatable body 10 is driven synchronously with the crankshaft and is thereby rotated about the rotational axis 0 while maintaining the relative phase with respect to the crankshaft. At this time, a rotational direction of the driving-side rotatable body 10 is a counterclockwise direction in FIG. 3.

Figure 4:
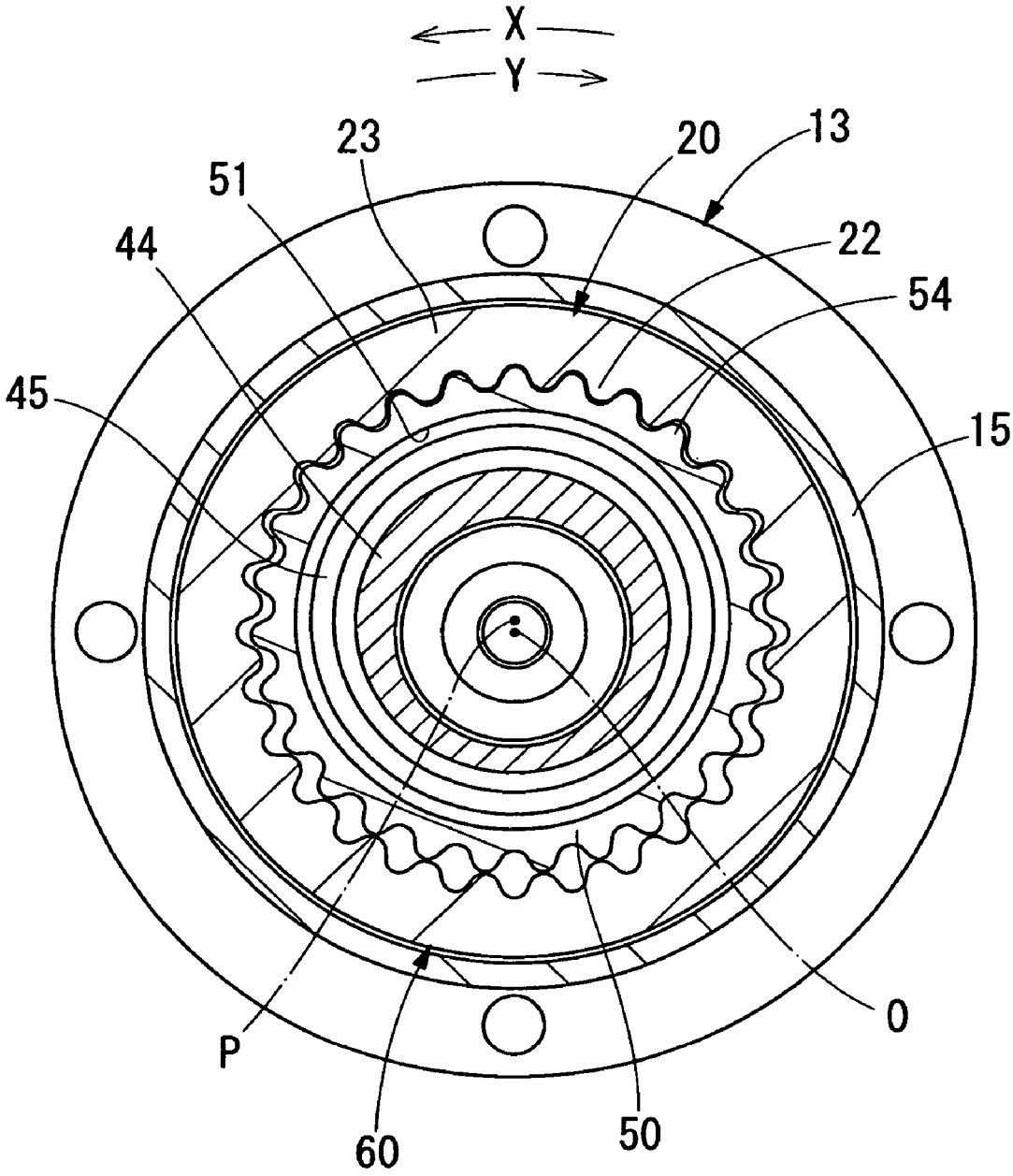
FIG. 4 is a cross sectional view taken along line IV-IV in FIG. 2.

As shown in FIGS. 2 and 4, the driven-side rotatable body 20 is a cup-shaped body and is arranged coaxial to the driving-side rotatable body 10 and the camshaft 2. A bottom wall of the driven-side rotatable body 20 forms a fixing portion 21, which is fixed to one axial end of the camshaft 2 by bolts. The driven-side rotatable body 20, which is coaxially connected to the camshaft 2 through the fixation with the bolts, can be rotated synchronously with the camshaft 2 about the rotational axis 0 while maintaining the relative rotational phase with respect to the camshaft 2. Furthermore, the driven-side rotatable body 20 is relatively rotatable with respect to the driving-side rotatable body 10. In the following description, a relative rotational direction, in which the driven-side rotatable body 20 is advanced relative to the driving-side rotatable body 10, will be referred to as an advancing direction X. In contrast, an opposite relative rotational direction, in which the driven-side rotatable body 20 is retarded relative to the driving-side rotatable body 10, will be referred to as a retarding direction Y.

A peripheral wall of the driven-side rotatable body 20 forms a driven-side inner gear 22, which has an addendum circle positioned radially inward of its dedendum circle and also has a tooth trace that extends in the axial direction. An inner diameter of the driven-side inner gear 22 is smaller than an inner diameter of the driving-side inner gear 14. Furthermore, the number of the teeth of the driven-side inner gear 22 is smaller than the number of the teeth of the driving-side inner gear 14. An outer peripheral wall of the driven-side inner gear 22 is engaged with an inner peripheral wall of the small diameter portion 16 and an inner peripheral wall of the stepped portion 17 of the sprocket 13, so that the driven-side rotatable body 20 rotatably supports the driving-side rotatable body 10 from a radially inner side of the driving-side rotatable body 10. An axial end portion of the driven-side inner gear 22, which is opposite from the fixing portion 21, includes a flange 23, which projects radially outward. The flange 23 is clamped between an end surface 24 of the driving-side inner gear 14 and an end surface 25 of the stepped portion 17, which are axially opposed to each other. With this clamping structure, the driven-side inner gear 22 and the driving-side inner gear 14 are placed adjacent to each other in such a manner that an axial extent of the driven-side inner gear 22 and an axial extent of the driving-side inner gear 14 do not overlap with each other. Furthermore, the axial relative movement of the driving-side rotatable body 10 with respect to the driven-side rotatable body 20 is limited.

As shown in FIG. 2, the control unit 30 includes an electric motor 32 and a power supply control circuit 33. The electric motor 32 is arranged on an opposite side of the rotatable bodies 10, 20, which is opposite from the camshaft 2. The electric motor 32 may be, for example, a brushless motor and includes a motor case 31 and a motor shaft 34. The motor case 31 is fixed to the internal combustion engine through a stay (not shown), and the motor shaft 34 is supported by the motor case 31 in such a manner that the motor shaft 34 is rotatable in a normal direction and a reverse direction. The power supply control circuit 33 is an electric circuit, such as a microcomputer, and is arranged outside or inside of the motor case 31 such that the power supply control circuit 33 is electrically connected to the electric motor 32. The power supply control circuit 33 controls the power supply to a coil (not shown) of the electric motor 32 based on, for example, an operational state of the internal combustion engine. Through this power supply control, the electric motor 32 forms a rotating magnetic field around the motor shaft 34, so that the electric motor 32 outputs a rotational torque from the motor shaft 34 in the corresponding direction X or Y (see FIG. 5), which corresponds to the direction of the rotating magnetic field.

Figure 5:
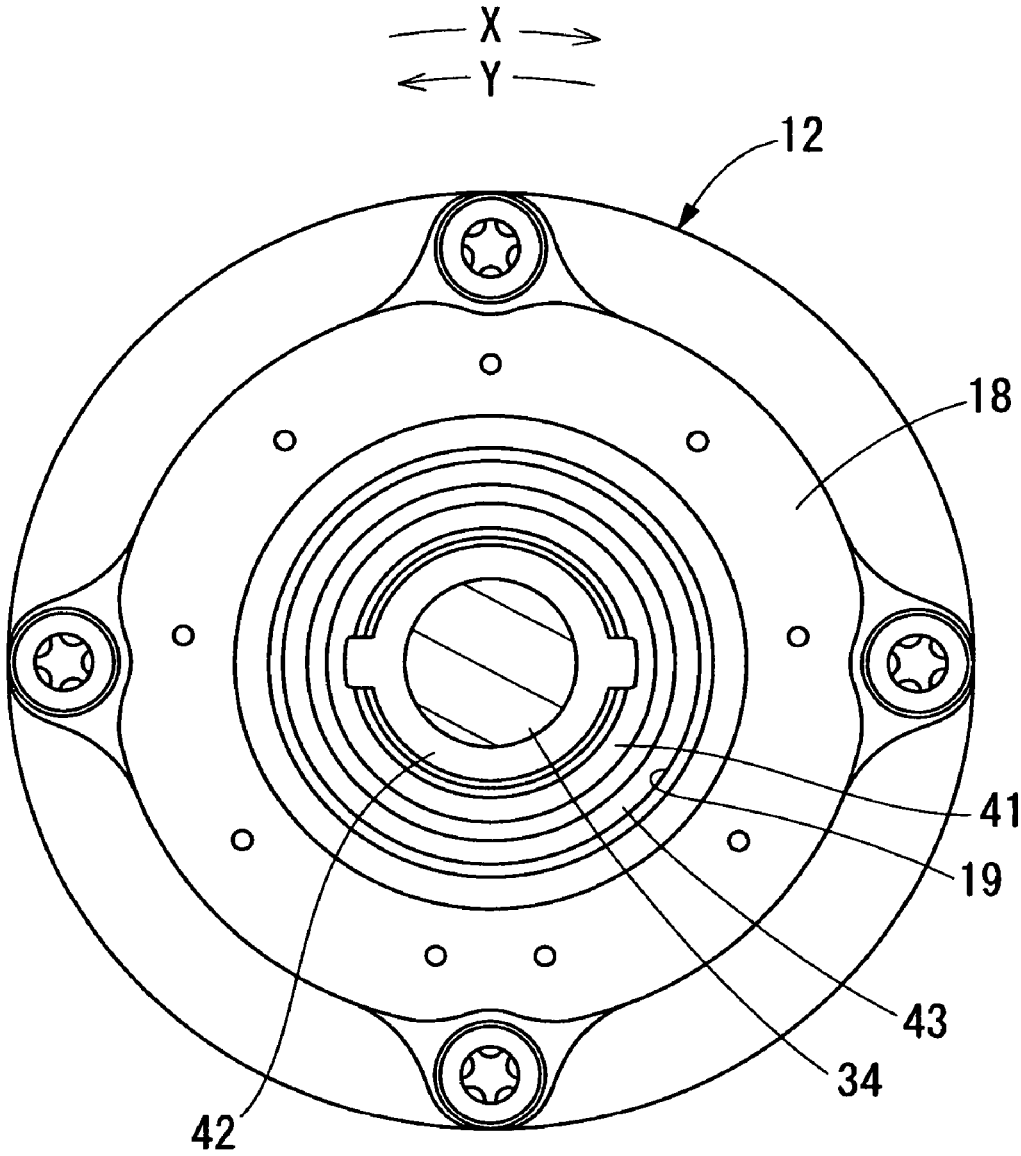
FIG. 5 is a cross sectional view taken along line V-V in FIG. 2.

As shown in FIGS. 2 and 5, an input portion 41 of the planet carrier 40 is a cylindrical body, which is coaxial with the rotatable bodies 10, 20 and the shafts 2, 34. The input portion 41 of the planet carrier 40 is fixed to the motor shaft 34 through a coupling 42. Through this fixation, the planet carrier 40 can be rotated synchronously with the motor shaft 34. Furthermore, the planet carrier 40 is relatively rotatable with respect to the driving-side rotatable body 10. The input portion 41 is arranged inside a central hole 19, which axially penetrates through a bottom wall 18 of the gear member 12. Furthermore, the input portion 41 supports the driving-side rotatable body 10 on the radially inner side of the driving-side rotatable body 10 through a bearing 43.

As shown in FIGS. 2 and 3, an eccentric portion 44 of the planet carrier 40, which is located on a fixing portion 21 side of the input portion 41, is a cylindrical body, which has an outer peripheral wall that is eccentric to the rotatable bodies 10, 20 and the shafts 2, 34. The eccentric portion 44 is arranged inside a central hole 51, which axially penetrates through the planet gear 50. The eccentric portion 44 supports the planet gear 50 on a radially inner side of the planet gear 50 through a bearing 45. Through this support, the planet gear 50 can rotate about an eccentric axis P, which is a central axis of the outer peripheral wall of the eccentric portion 44, and can revolve in the rotational direction of the eccentric portion 44. Specifically, the planet gear 50 is arranged to have a sun-and-planet motion.

As shown in FIGS. 2 to 4, the planet gear 50 is a double stepped cylindrical body and forms a driving-side outer gear 52 and a driven-side outer gear 54 at its large diameter portion and a small diameter portion, respectively. Each of the driving-side outer gear 52 and the driven-side outer gear 54 has an addendum circle positioned radially outward of its dedendum circle and also has a tooth trace that extends in the axial direction. Here, the number of teeth of the driving-side outer gear 52 is set to be smaller than the number of teeth of the driving-side inner gear 14 by a predetermined number N (one in this instance). Furthermore, the number of teeth of the driven-side outer gear 54 is set to be smaller than the number of teeth of the driven-side inner gear 22 by the predetermined number N. Therefore, the number of the teeth of the driven-side outer gear 54 is smaller than the number of the teeth of the driving-side outer gear 52. The driving-side outer gear 52 is arranged radially inward of the driving-side inner gear 14 to mesh with a portion of the driving-side inner gear 14. The driven-side outer gear 54, which is located on a fixing portion 21 side of the driving-side outer gear 52, is arranged radially inward of the driven-side inner gear 22 to mesh with a portion of the driven-side inner gear 22. Here, it should be understood that each inner gear 14, 22 is located radially outward of the corresponding outer gear 52, 54 and has gear teeth, which extend radially inward. Likewise, each outer gear 52, 54 is located radially inward of the corresponding inner gear 14, 22 and has gear teeth, which extend radially outward.

With the above construction, the driving-side inner gear 14 and the driven-side inner gear 22 are connected through the planet gear 50 at the radially outward of the eccentric portion 44 to form a differential gear mechanism 60 in the internal space 11 of the rotatable bodies 10, 20. In the differential gear mechanism 60, when the planet carrier 40 does not rotate relative to the driving-side rotatable body 10, the planet gear 50 rotates together with the rotatable bodies 10, 20 while maintaining the meshed position between the outer gears 52, 54 and the inner gears 14, 22. In this way, the relative rotational phase between the rotatable bodies 10, 20 is maintained, so that the valve timing is also maintained. When the planet carrier 40 is rotated relative to the driving-side rotatable body 10 in the advancing direction X due to an increase in the rotational torque in the direction X, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the advancing direction X. Therefore, the valve timing is advanced. When the planet carrier 40 is rotated relative to the driving-side rotatable body 10 in the retarding direction Y due to an increase in the rotational torque in the direction Y or due to abrupt stop of the electric motor 32, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the retarding direction Y. Therefore, the valve timing is retarded. Particularly, in the case where the electric motor 32 stops abruptly, it is possible to implement the valve timing at the most retarded phase, which enables the starting of the internal combustion engine.

Figure 1:
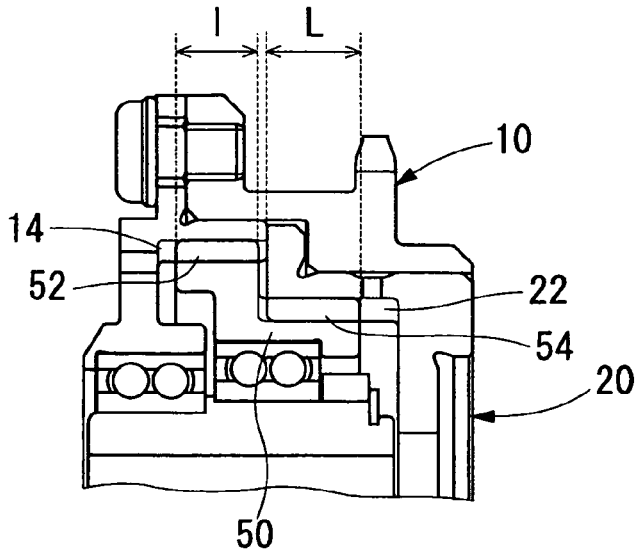
FIG. 1 is a schematic partial view showing a characteristic part of a valve timing adjusting apparatus according to an embodiment of the present invention.

In the present embodiment, which enables the above described operation of the differential gear mechanism 60, the inner diameter of the driven-side inner gear 22 is set to be smaller than the inner diameter of the driving-side inner gear 14. Furthermore, the number of the teeth of the driven-side inner gear 22 is set to be smaller than the number of the teeth of the driving-side inner gear 14. Therefore, an upper limit is imposed on the inner diameter of the driven-side inner gear 22. Furthermore, an oscillating torque of the camshaft 2 is directly transmitted to the driven-side rotatable body 20, which has the driven-side inner gear 22. As a result, it is difficult to reduce the moment, which is applied to the teeth of the driven-side inner gear 22, due to the oscillating torque or the like. To address this disadvantage, in the present embodiment, as shown in FIG. 1, a length L of a tooth contact between the driven-side inner gear 22 and the driven-side outer gear 54 measured in the direction of the tooth trace thereof is set to be greater than a length I of a tooth contact between the driving-side inner gear 14 and the driving-side outer gear 52 measured in the direction of the tooth trace thereof. In this way, a total surface area of the tooth contact between the driven-side inner gear 22 and the driven-side outer gear 54 is increased, so that it is possible to minimize the surface pressure generated at the tooth contact part between the driven-side inner gear 22 and the driven-side outer gear 54 due to, for example, the torque fluctuation of the camshaft 2. Therefore, the sufficient durability of the driven-side inner gear 22 and of the driven-side outer gear 54 can be achieved without substantially increasing the rigidity of the driven-side inner gear 22 and of the driven-side outer gear 54. Therefore, the costs can be reduced, and the accurate valve timing adjustment can be maintained for a long time period.

In the present embodiment, the driven-side rotatable body 20 corresponds to a first rotatable body of the present invention, and the driving-side rotatable body 10 corresponds to a second rotatable body of the present invention. Furthermore, the driven-side inner gear 22 corresponds to a first inner gear of the present invention, and the driving-side inner gear 14 corresponds to a second inner gear of the present invention. In addition, the driven-side outer gear 54 corresponds to a first outer gear of the present invention, and the driving-side outer gear 52 corresponds to a second outer gear of the present invention.

The embodiment of the present invention is described above. However, the present invention is not limited to the above embodiment and can be implemented in various other forms without departing the scope and spirit of the present invention.

For example, in the above embodiment, the inner diameter of the driven-side inner gear 22 is set to be smaller than the inner diameter of the driving-side inner gear 14, and the number of the teeth of the driven-side inner gear 22 is set to be smaller than the number of the teeth of the driving-side inner gear 14. This relationship can be reversed. That is, in the above embodiment, the inner diameter of the driven-side inner gear 22 may be set to be larger than the inner diameter of the driving-side inner gear 14, and the number of the teeth of the driven-side inner gear 22 may be set to be larger than the number of the teeth of the driving-side inner gear 14.

Furthermore, in the above embodiment, the valve timing adjusting apparatus 1, which adjusts the valve timing of the intake valve, is described. However, the present invention can be implemented in an apparatus, which adjusts valve timing of an exhaust valve or in an apparatus, which adjusts both of the intake valve and the exhaust valve. Furthermore, in the case where the present invention is implemented in the apparatus, which adjusts the valve timing of the exhaust valve, the inner diameter of the driven-side inner gear 22 is desirably larger than the inner diameter of the driving-side inner gear 14, and the number of the teeth of the driven-side inner gear 22 is desirably larger than the number of the teeth of the driving-side inner gear 14. In this way, when the planet carrier 40 is rotated in the retarding direction Y relative to the driving-side rotatable body 10 due to, for example, the abrupt stop of the electric motor 32, the driven-side rotatable body 20 is rotated in the advancing direction X relative to the driving-side rotatable body 10. Therefore, in the case of the abrupt stop of the electric motor 32, it is possible to implement the valve timing at the most advanced phase, which enables the starting of the internal combustion engine. Furthermore, in the case where the present invention is implemented in the apparatus, which adjusts the valve timing of the exhaust valve, the inner diameter of the driven-side inner gear 22 may be set to be smaller than the inner diameter of the driving-side inner gear 14, and the number of the teeth of the driven-side inner gear 22 may be set to be smaller than the number of the teeth of the driving-side inner gear 14.

Furthermore, in the above embodiment, the driven-side rotatable body 20 is connected to the camshaft 2 with the bolts. Alternatively, the driven-side rotatable body 20 may be connected to the camshaft 2 through a rotation transmitting member (e.g., a timing chain, a timing belt).

Furthermore, in the above embodiment, the sprocket 13 is provided to the driving-side rotatable body 10, and the driving-side rotatable body 10 is connected to the crankshaft through the timing chain. Alternatively, for example, a pulley may be provided to the driving-side rotatable body 10, and the driving-side rotatable body 10 may be connected to the crankshaft through a rotation transmitting member (e.g., a timing belt).

Furthermore, in the above embodiment, the control unit 30 includes the electric motor 32 to generate the rotational torque. Alternatively, the control unit may include, for example, a hydraulic motor or an electromagnetic brake to generate the rotational torque.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus that adjusts valve timing of at least one of an intake valve and an exhaust valve of an internal combustion engine, which are opened and closed by a camshaft upon transmission of a torque from a crankshaft to the camshaft, the valve timing adjusting apparatus comprising:

a first rotatable body that includes a first inner gear and is rotated synchronously with the camshaft;

a second rotatable body that includes a second inner gear, which has an axial extent that does not overlap with an axial extent of the first inner gear, wherein the second rotatable body is rotated synchronously with the crankshaft; and a planet gear that includes a first outer gear and a second outer gear, wherein:

the first outer gear and the second outer gear are meshed with and are driven together with the first inner gear and the second inner gear, respectively, to have a sun-and-planet motion, so that the planet gear changes a relative rotational phase between the first rotatable body and the second rotatable body; and a length of a tooth contact between the first inner gear and the first outer gear measured in a direction of a tooth trace thereof is set to be greater than a length of a tooth contact between the second inner gear and the second outer gear measured in a direction of a tooth trace thereof.

2. The valve timing adjusting apparatus according to claim 1, wherein the first rotatable body is connected to the camshaft.

3. The valve timing adjusting apparatus according to claim 1, wherein a diameter of the first inner gear is smaller than a diameter of the second inner gear.

4. The valve timing adjusting apparatus according to claim 1, further comprising:

a planet carrier that rotatably supports the planet gear from a radially inner side of the planet gear, wherein the planet carrier rotates in a revolving direction of the planet gear; and a control unit that controls a rotational torque applied to the planet carrier.

5. The valve timing adjusting apparatus according to claim 4, wherein the control unit includes an electric motor, which generates the rotational torque.

6. The valve timing adjusting apparatus according to claim 5, wherein:

the valve timing adjusting apparatus adjusts the valve timing of the intake valve; and when the planet carrier is rotated relative to the second rotatable body in a retarding direction due to the rotational torque, the first rotatable body is rotated relative to the second rotatable body in the retarding direction.

* * * * *